United States Patent [19]

Dixon et al.

[11] 4,036,313

[45] July 19, 1977

[54] MOUNTING FOR INBOARD CUTTERS ON A RAISE DRILL

[75] Inventors: Robert L. Dixon, Brea; Malcolm D. Maxsted, Harbor City, both of Calif.

[73] Assignee: Smith International, Inc., Irvine, Calif.

[21] Appl. No.: 593,036

[22] Filed: July 3, 1975

[51] Int. Cl.[2] ..... E21B 9/24

[52] U.S. Cl. ..... 175/344; 175/53; 175/364; 175/340

[58] Field of Search ..... 175/53, 334, 335, 342, 175/350, 357, 358, 360, 361, 362, 363, 374, 346, 347, 364, 344; 299/86; 308/8.2, 15

[56] References Cited

U.S. PATENT DOCUMENTS

| | | | |
|---|---|---|---|
| 2,103,583 | 12/1937 | Howard et al. | 175/344 |
| 2,695,771 | 11/1954 | Salvatori et al. | 175/346 |
| 3,638,740 | 2/1972 | Justman | 175/344 |
| 3,659,659 | 5/1972 | Lichte | 175/334 X |
| 3,675,729 | 7/1972 | Neilson | 175/344 X |
| 3,750,772 | 8/1973 | Venter | 175/374 X |
| 3,791,705 | 2/1974 | Schimel | 175/363 |

*Primary Examiner*—Ernest R. Purser
*Assistant Examiner*—Richard E. Favreau
*Attorney, Agent, or Firm*—Christie, Parker & Hale

[57] ABSTRACT

A raise drill having a central drive stem to which a surrounding cutter mounting frame is attached, the cutter mounting frame supporting a plurality of rotary cutter units. One or more inboard cutter units each include a shaft and a rotary cutter journaled for rotation on the shaft. One end of the shaft is inserted in a bore extending into the side of the stem. A yoke member receives the outer end of the shaft. The yoke member is supported by a mounting block secured to the frame. The mounting block has first and second intersecting planar surfaces, the first surface extending substantially parallel to the axis of the bore and the second surface extending in an obtuse angle to the first surface facing the stem. The yoke member has a first surface which slidably engages the first surface of the mounting member, and a second surface spaced from the second surface of the mounting member, allowing axial movement of the cutter shaft into and out of the bore. A spacer or shim is inserted between the second surfaces after the shaft is inserted in the bore and bolts extending between the yoke and the mounting block pull the yoke against the mounting block and at the same time clamp the spacer in place.

19 Claims, 4 Drawing Figures

MOUNTING FOR INBOARD CUTTERS ON A RAISE DRILL

FIELD OF THE INVENTION

This invention relates to large rock drills, and more particularly, is concerned with the mounting of inboard cutters on a raise drill.

BACKGROUND OF THE INVENTION

In the design of large hole rock cutters, such as raise drills, a plurality of rotary cutters are mounted on a frame in the form of a disk having a drive stem attached at the centr for imparting rotation to the disk. The cutter units are positioned at various radial distances from the axis of rotation. Such a drill is described, for example, in U.S. Pat. No. 3,675,729. The tool is used by first drilling a small pilot hole between the two levels. A drill string is then lowered through the pilot hole from rotary drive equipment at the upper level and a raise drill tool is attached at the lower level to the drill string. The drill is then drawn upwardly while simultaneously being rotated by the drill string, the drill reaming out the hole to the desired diameter. In an exemplary embodiment the pilot hole may be 11 inches diameter and the raise drill reams out a hole 6 feet in diameter. To permit initial installation and replacement of the rotary cutters as they wear, various detachable mounting arrangements have been provided. Typically the cutter is journaled on a shaft or pin, the ends of the pin being anchored to a yoke structure. Various clamping means for releasably securing the ends of the shaft to permit removal of the shaft and the cutter have been proposed. See, for example, U.S. Pat. No. 3,612,196. This mounting arrangement must provide very rigid anchoring to prevent loosening or wear by the severe vibration and shocks to which the drill is subjected.

In the past considerable difficulty has been experienced in the mounting of the inboard cutters in this regard. The inboard cutters must be mounted with the cutters tangent to or slightly recessed into the drive stem in a raise drill to assure reaming adjacent the pilot hole in which the stem travels. As a result, the inboard cutters are usually mounted by inserting the inner end of the journal shaft of the cutter into a radial bore in the drive stem. The other end of the journal shaft is supported from the disk in a manner which allows the journal shaft to be moved axially to permit the shaft to be inserted or withdrawn from the bore in the drive stem.

To permit the shaft to slide in and out of the bore, the bore must be slightly larger in diameter than the shaft. Under normal tolerances, this allows some room for play between the shaft and the bore, resulting in wear and gradual loss of rigidity in the mounting of the inboard cutters under the constant vibration and pounding experienced by the drill. Heretofore there has been no effective way of securely locking the inner end of the journal shaft in the bore to prevent relative movement and wear between the journal shaft and the drive stem.

SUMMARY OF THE INVENTION

The present invention is directed to an improved mounting arrangement for mounting the inboard rotary cutters of a raise drill which permits easy removal of the cutters and yet securely locks the cutter and associated journal shaft in place. This is accomplished in brief by providing in a raise drill having a drive stem and a transverse frame plate secured to the stem, a cutter assembly including a shaft with a rotary conical cutter journaled on the shaft. The stem has a bore for slidably receiving one end of the shaft. The other end of the shaft is supported from the frame plate by a mounting block having a planar surface extending substantially parallel to the axis of the bore. A yoke member secured to the end of the shaft has a planar surface parallel to and spaced from the longitudinal axis of the shaft for slidably engaging the planar surface of the mounting member to permit the shaft to be moved axially into the bore. A removable shim is inserted between the yoke member and a stop portion of the mounting block to lock the shaft in the bore. Bolt means passes through the mounting block and the shim into the yoke member to secure the yoke member in place, the yoke member and mounting block, when bolted together, holding the shaft in a slightly cocked position in the bore to remove any play between the shaft and the stem.

DESCRIPTION OF THE DRAWINGS

For a better understanding of the invention, reference should be made to the accompanying drawings, wherein.

DETAILED DESCRIPTION

Figure 1:
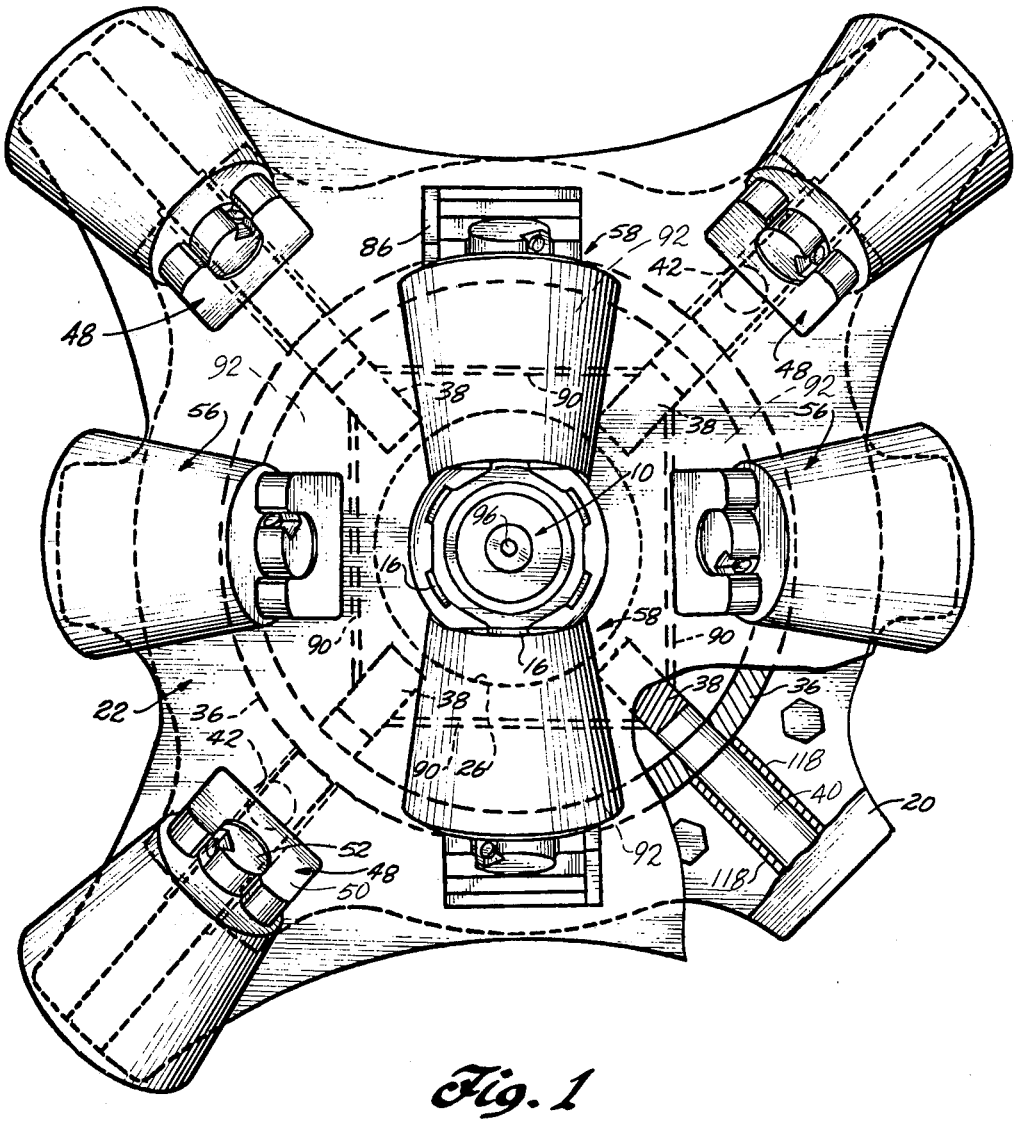
FIG. 1 is a plan view of a raise drill incorporating the features of the present invention.

Referring to the drawings in detail, the numeral 10 indicates generally the drive shaft or stem of the raise drill. The upper end of the stem is provided with a tapered thread 12 by which it can be threaded into a standard drill string through which the raise drill may be driven. The stem includes a fluted portion 14 having hard facing strips or plates 26 attached to provide protection for the stem where it enters the pilot hole which is being reamed out by the raise drill.

The lower end of the stem, as indicated at 18, is welded or otherwise rigidly attached to a transverse torque plate 20. The torque plate 20 transfers torque from the stem 10 to a detachable rotary drill bit assembly, indicated generally at 22. The rotary drill bit assembly, as hereinafter described in detail, fits down over the upper end of the stem 10 and is bolted to the torque plate 20. The stem 10, together with the torque plate 20, can be replaced as a unit by detaching the torque plate 20 from the assembly 22 and withdrawing the stem.

The drill bit assembly 22 includes a main frame plate 24 having a central opening 26 which has a diameter only slightly larger than the central shank portion 28 of the stem 10. The central shank portion 28 is of a smaller diameter than the lower end 18 of the stem 10, forming a shoulder 30 against which the margin of the hole 26 in the main frame plate 24 fits when the assembly 22 is in the assembled position with the stem 10.

The frame plate 24 is part of a frame assembly which includes a flange plate 32 having a central opening 34 which is slightly larger in diameter than the lower end 18 of the stem 10. The flange plate 32 is rigidly secured in parallel relation to the main frame plate 24 by a cylindrical collar 36 which is concentric with the openings 26 and 34. The plates 24 and 32 are also joined by four radial plates, each of which include an inner section 38 positioned on the inside of the collar 36, and an outer section 40 positioned on the outside of the collar 36. The collar 36 and inner and outer radial plate sections 38 and 40 are welded to the frame plate 24 and flange plate 32 to form a unitary frame structure for the assembly 22.

The spacing between the parallel plates 24 and 32 is such that when the frame plate 24 engages the shoulder 30 the flange plate 32 is in close proximity to the torque plate 20. Torque is transferred from the torque plate 20 to the adjacent flange plate 32 by a pair of drive pins 42. The pins 42 are anchored in the torque plate 20 and engage mating holes in the flange plate 32 for locking the two plates against relative rotation. A plurality of bolts 44 extend through aligned holes in the plates 24 and 32 and are held in place by nuts 46. When the nuts are tightened on the bolts, the bottom section 18 of the stem 10 is clamped securely between the frame plate 24 and the torque plate 20. By this arrangement, a substantial part of the axial load is transferred from the cutter assembly 22 to the stem 10 through the shoulder 30, while the torque load is transferred through the pins 42.

Figure 2:
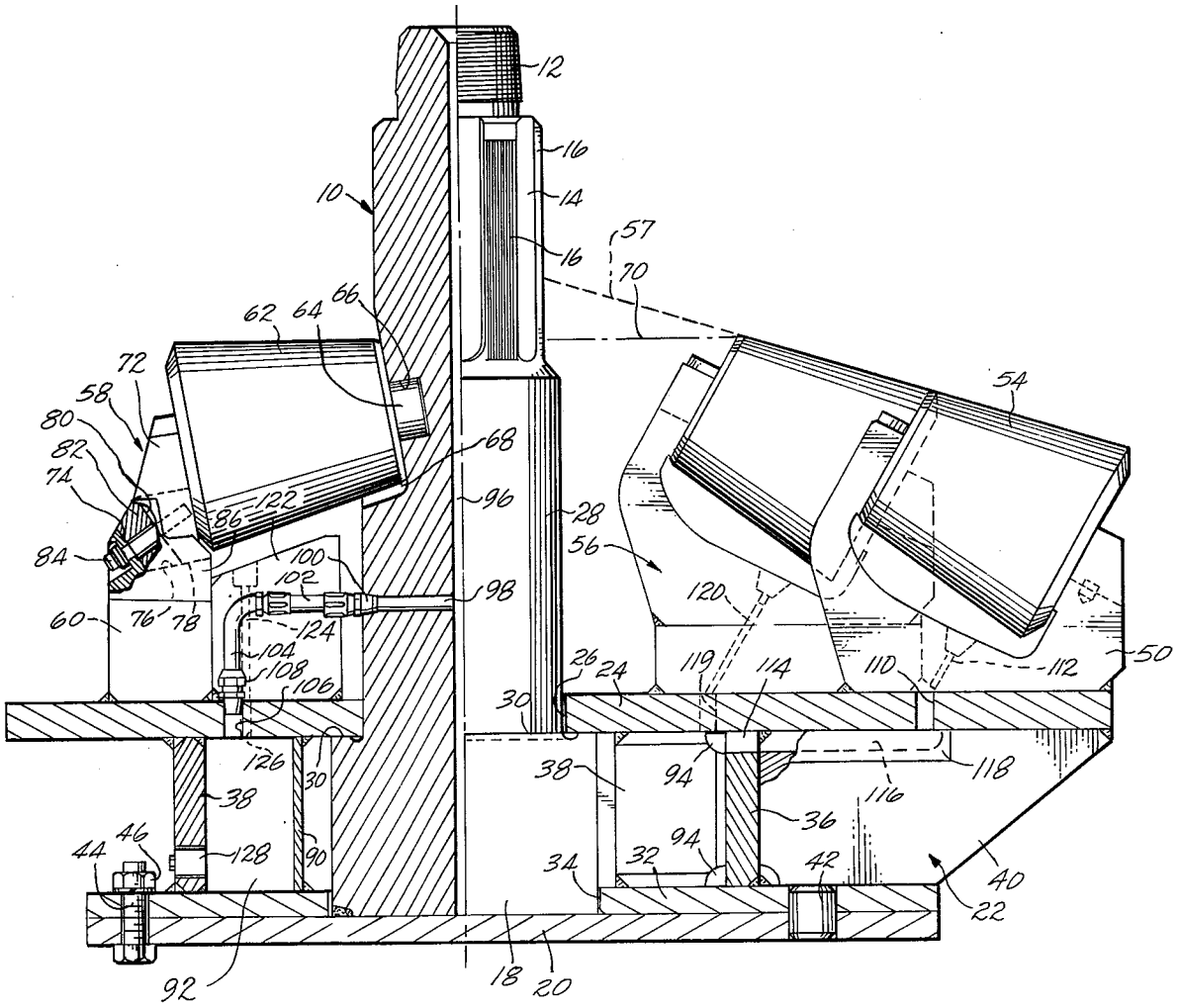
FIG. 2 is an elevational view partially in section with the cutters projected in the same plane.
Figure 3:
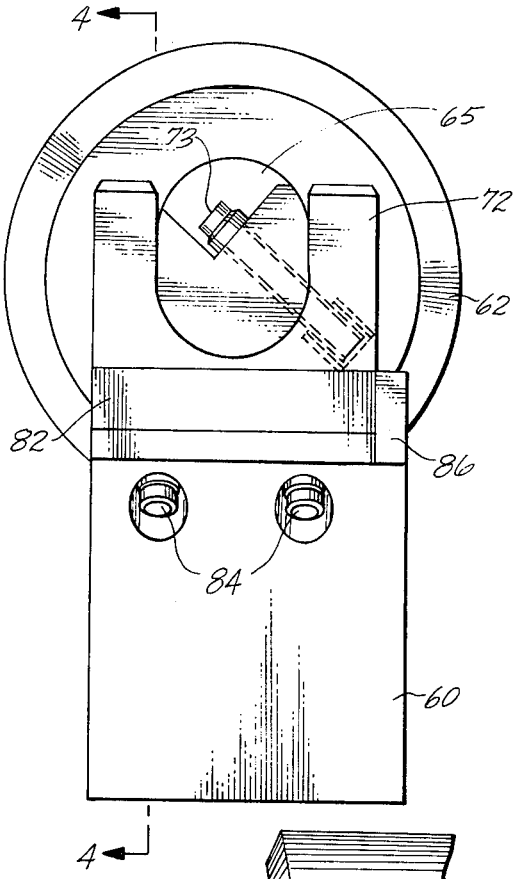
FIG. 3 is an end view of the inner cutter assembly and associated mounting.
Figure 4:
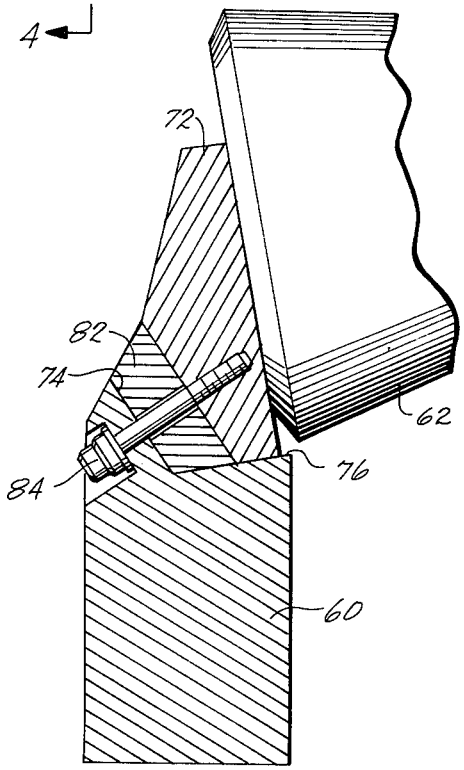
FIG. 4 is a sectional view taken substantially along the line 4—4 of FIG. 3.

Four outer rotary cutter units 48 are mounted on the main frame plate 24. Each cutter unit includes a mounting yoke 50 which supports both ends of a shaft 52 on which is journaled a conical shaped rock cutter 54. While the cutters 54 are illustrated for clarity as smooth truncated cones, it will be recognized by one skilled in the art that such cutters have a plurality of hardened steel or tungsten carbide teeth for pulverizing rock. Two similar intermediate cutter units are also mounted on the main frame plate 24 at a smaller distance from the axis of rotation of the stem, as indicated at 56. As seen in FIG. 2 in which the cutters are projected into the same plane, the conical cutters of the outer units 48 and intermediate units 56 lie tangent to a common conical surface 57 whose axis of rotation corresponds to the axis of the stem 10.

In addition, two inner cutter units, indicated generally at 58, are supported on mounting blocks 60 welded to the main frame plate 24. The conical rotary cutter 62 is journaled on a fixed shaft 64, one end of which is mounted in a bore 66 in the stem 10. The pin 64 is indicated by simple parallel lines in FIG. 2. It will be appreciated that various bearings, seals and the like will be incorporated for mounting the rotating cutter on the fixed shaft 64. These are conventional and are omitted herein for clarity in illustration. The stem 10 includes a recess or counterbore 68 for providing clearance for the inner end of the conical cutter 62. The shaft 64 and bore 66 extend at an angle such that the cutting surface of the inner cutters 62 are tangent to a plane 70 which is perpendicular to the axis of the stem. The enlarged outer end 65 of the shaft 64 is rigidly joined to a yoke member 72 by a diagonal bolt 73. The yoke member 72 is removably secured to the block 60 in a manner to permit the shaft 64 to be inserted into the bore 66. To this end, the top of the mounting block 60 is formed with a first flat surface 74 facing generally inwardly towards the stem 10. This first flat surface 74 intersects at an obtuse angle a second inclined flat surface 76 which lies in a plane parallel to the rotational axis of the conical cutter 62 and faces generally upwardly. The inwardly facing surface 74 acts as a stop. The yoke member 72 has a mating surface 78 parallel to the axis of rotation of the cutter which is slidable along the upwardly facing surface 76. The yoke member 72 also has a flat outwardly facing surface 80 which is parallel to the stop surface 74.

To insert the cutter 62 into operating position, the yoke member 72 is lowered onto the surface 76 with its outwardly facing surface 80 near the stop surface 74 of the mounting block 60. The inner end of the shaft 64 lies outside the bore 66 when the yoke member 72 is in this position. The cutter 62 is then moved axially to press the shaft 64 into the bore 66 by sliding the surface 78 of the yoke member 72 inwardly along the surface 76. With the shaft 64 fully inserted in the bore 66, a shim or spacer 82 is inserted between the surfaces 74 and 80. The shim has parallel faces that fit between the outwardly facing surface 80 on the yoke and the stop surface on the mounting block 60. The yoke member 72 is then anchored in position by a pair of bolts 84 that extend perpendicular to the parallel surfaces 74 and 80 on the mounting block and yoke, respectively, through aligned holes in the block 60 and shim 82, the inner ends of the bolts threadedly engaging the yoke member 72.

The angle of the bolts 84 is in a direction perpendicular to the surface 74 and an acute angle to the surface 76 to pull downwardly and outwardly on the yoke member 72, thereby securely clamping the yoke member 72 against the inclined surface 76 on the mounting block, while at the same time clamping the shim 82 securely in place. Normal machining and welding tolerances are such that in pulling downwardly on the yoke member 72, the tightening of the bolts 84 tends to cock the shaft 64 slightly in the bore 66, thus removing any play that might exist between the shaft 64 and the bore 66 that could otherwise be a source of wear. The block 60 is provided with a plate 86 which is welded to the block 60 and acts as a lateral stop for absorbing part of the lateral load between the cutter 62 and the mounting block 60 resulting from rotation of the stem 10.

Four relatively thin, flat rectangular plates 90 are welded inside the collar 36 between the main frame plate 24 and flange plate 32 to provide a manifold for a coolant, such as water, for the rotary cutters. The plates 90 terminate at the inner radial plate sections 38, the plates 90 forming one wall of four enclosed chambers 92. The fluid communication between the chambers is provided by notching the corners of the inner radial plate sections 38, as indicated at 94. Fluid is admitted to the interconnected chambers 92 by means of a central passage 96 along the axis of the stem 10. A radial passage 98 receives a fitting 100 on the outside of the stem 10 to which a hose or other flexible fluid coupling 102 is attached. The flexible coupling 102 connects to a tube section 104 which in turn is connected to a passage 106 through the frame plate 24 by a fitting 108. The passage 106 opens into the chamber 92. Thus a coolent fluid can be pumped through the center of the drill stem into the passage 96 and radial passage 98 and through the fluid coupling into the passage 106 for filling the fluid chambers 92.

Outlet passages 110 through the frame plate 24 intersect with spray passages 112 in the yokes 50, the spray passages directing the fluid in a spray out against the surface of the associated rotary cutters 54. The cooling fluid passes from the chambers 92 to the passages 110 through openings 114 in the collar 36 through a passage formed by a recess 116 in the edge of the outer radial plate section 40. Cover plates 118 are welded or otherwise affixed to cover the recess 116 to provide a fluid-tight passage.

Similarly, an outlet passage 119 through the frame plate 24 communicates with a passage 120 through the supporting yokes of the intermediate cutter units 56 to provide a coolant spray for these cutters.

The inner cutters 62 are provided with an associated spray unit 122 having a passage 124 which communicates with the chamber 92 through a passage 126. A removable plug 128 in the collar 36 may be provided for draining the chamber 92.

Although described in relation to a raise drill pulled by a drill string through a pilot hole, it will be apparent that the cutter mounting has other applications. One, for example, is a large hole drill driven from what is the lower end in the illustrated embodiment and wherein the stem supports a pilot drill. Other variations will be apparent. For example, the shaft 64 on which the cutter is mounted may be integral with the yoke member at the end. If desired, the lower portion of the yoke member may be peaked and the upwardly facing surface on the mounting member may be in the form of a complementary shallow V. In such an embodiment the surfaces and the "valley" of the V-shaped face of the mounting member are parallel to the axis of the bore. Many other modifications and variations will be apparent to one skilled in the art.

What is claimed is:

1. A raise drill comprising:

a drive stem adapted to be connected to a rotating drill string, a cutter mounting frame secured to the drive stem and projecting radially therefrom, a cutter assembly including a shaft and a rotary cutter journaled for rotation on the shaft, the shaft projecting beyond the ends of the cutter, the stem having a bore for receiving one end of the cutter shaft, a yoke member receiving the other end of the shaft, means securing the shaft end to the yoke member, means for mounting the yoke member to the cutter mounting frame including a mounting member secured to the frame, the mounting member having first and second intersecting planar surfaces, the first surface extending substantially parallel to the axis of said bore, and the second surface extending at an obtuse angle to the first surface and facing the stem, the yoke member having a first surface substantially parallel to the axis of rotation of the cutter adapted to slidably engage the first surface of the mounting member, and a second surface spaced from the second surface of the mounting member and parallel thereto, a spacer inserted between said second surfaces, and means extending between the yoke member and mounting member for clamping the spacer between said second surfaces.

2. Apparatus of claim 1 wherein said means for clamping the spacer includes at least one bolt extending through a portion of the mounting member and threadedly engaging the yoke member.

3. Apparatus of claim 2 wherein the bolt extends through the spacer along a line extending at an acute angle to the first surface of the mounting member.

4. Apparatus for removably mounting a rotary cutter to a drilling tool having a drive stem and a supporting frame secured to and extending radially outward of the stem, comprising:

a cutter assembly including a shaft and a cutter journaled on the shaft, the shaft having an inner end nearer the stem and an outer end further from the stem, the stem having a bore slidably receiving the inner end of the shaft, the supporting frame including a mounting member having a planar surface extending substantially parallel to the axis of the bore, a support member secured to the outer end of the shaft having a planar surface substantially parallel to the longitudinal axis of the shaft, the planar surface of the support member slidably engaging the first planar surface of the mounting member when the shaft is inserted into the bore, a removable shim, the mounting member having a stop portion extending at a substantial angle to the planar surface, the shim being inserted between the stop portion and the support member after the shaft is inserted in the bore to lock the shaft axially in the bore, and bolt means securing the support member to the mounting member with said planar surfaces in contact and the shaft inserted in the bore.

5. Apparatus of claim 4 wherein the support member and mounting member when bolted together hold the shaft in a slightly cocked position in the bore to remove any play between the shaft and the stem.

6. Apparatus of claim 4 wherein the stop portion of the mounting member has a second planar surface projecting upwardly from the first-mentioned planar surface facing generally towards the stem, the support member having a second planar surface substantially parallel to the second planar surface of the mounting member, the shim fitting between said second planar surfaces to hold the shaft in the bore.

7. Apparatus of claim 4 wherein the bolt means passes through the shim.

8. Apparatus of claim 4 wherein the stop portion has a planar surface extending at an obtuse angle to the planar surface of the mounting member.

9. Apparatus of claim 8 wherein the bolt means extends at an acute angle to said planar surface of the mounting member to urge the support member simultaneously toward both the planar surface of the mounting member and the planar surface of the stop portion.

10. In a rotary drilling tool including a stem, a cutter mounting frame secured to the stem and projecting radially therefrom, a cutter assembly including a shaft and a rotary cutter journaled for rotation on the shaft, the shaft projecting beyond the ends of the cutter, the stem having a bore for receiving the inboard end of the cutter shaft, and a yoke member receiving the outboard end of the cutter shaft, improved means for mounting the yoke member to the cutter mounting frame comprising:

a mounting member secured to the frame, the mounting member having a first surface extending substantially parallel to the axis of the bore, and a second surface extending at an angle to the first surface and facing the stem, the yoke member having a first surface substantially parallel to the axis of rotation of the cutter adapted to slidably engage the first surface of the mounting member, and a second surface spaced from the second surface of the mounting member and parallel thereto;

a removable spacer inserted between said second surfaces; and means extending between the yoke member and mounting member for clamping the spacer between said second surfaces.

11. In a rotary drilling tool as defined in claim 10 the further improvement wherein the means for clamping comprises a bolt extending through the spacer along a line extending at an acute angle to the first surface of the mounting member.

12. In a rotary drilling tool as defined in claim 10, the further improvement wherein the second surfaces are at an obtuse angle from the first surfaces and the means for clamping also forces the first surface on the yoke member against the first surface on the mounting member.

13. In a rotary drilling tool as defined in claim 10 the further improvement wherein each first surface is a single planar surface at an obtuse angle from the respective second surface.

14. In a rotary drilling tool as defined to claim 13 the further improvement wherein the means for clamping comprises a bolt extending through the spacer along a line extending at an acute angle to the first surface of the mounting member.

15. Means for mounting a replaceable rock boring cutter assembly comprising a fixed shaft and rock boring cutter mounted for rotation on the fixed shaft onto a drive stem, the cutter and shaft each having an inner end nearer the stem and an outer end further from the stem, comprising:

a bore in the stem for receiving the inner end of the shaft by insertion of the shaft in the direction of the axis of the shaft;

a counterbore in the stem including a surface normal to the axis of the bore for providing clearance for the inner end of the cutter;

means for forming a mounting surface facing generally towards the surface of the counterbore and defining a generally U-shaped opening therebetween for receiving the rock boring cutter assembly, the opening between the means for forming a mounting surface and the surface of the counterbore being sufficiently larger than the length of the shaft for permitting axial movement of the shaft for removal thereof from the means for mounting;

shim means removably fittable between the means for forming a mounting surface and a portion of the outer end of the shaft for permitting axial movement of the shaft when removed and preventing axial movement of the shaft when fitted between the outer end of the shaft and the means for forming a mounting surface; and means for connecting the outer end of the shaft and the shim means to the means for forming a mounting surface for securing the rock boring cutter assembly in the U-shaped opening.

16. Means for mounting a replaceable rock boring cutter assembly comprising a fixed shaft and rock boring cutter mounted for rotation on the fixed shaft onto a drive stem, the cutter and shaft each having an inner end nearer the stem and an outer end further from the stem, comprising:

a bore in the stem for receiving the inner end of the shaft by insertion of the shaft in the direction of the axis of the shafts;

a counterbore in the stem including a surface transverse to the axis of the bore for providing clearance for the inner end of the cutter;

means for forming a mounting surface facing generally towards the surface of the counterbore and defining an opening therebetween for receiving the rock boring cutter assembly;

shim means removably fittable between the means for forming a mounting surface and a portion of the outer end of the shaft for permitting axial movement of the shaft when removed and preventing axial movement of the shaft when fitted between the outer end of the shaft and the means for forming a mounting surface; and means for connecting the outer end of the shaft and the shim means to the means for forming a mounting surface for securing the rock boring cutter assembly in the U-shaped opening, wherein the connecting means comprises bolt means extending at an acute angle to the axis of the shaft and connected to the outer end of the shaft adjacent the means for forming a mounting surface.

17. Means for mounting as recited in claim 16 wherein the means for forming a mounting surface includes a surface portion normal to the axis of the bolt means.

18. Means for mounting as recited in claim 16 comprising means for forming a second mounting surface adjacent means for forming the first mentioned mounting surface and extending parallel to the axis of the shaft for supporting the outer end of the shaft.

19. Mounting means for a replaceable cutter assembly comprising:

a drive stem;

a bore in the side of the drive stem;

a counterbore in the side of the stem having a surface transverse to the axis of the bore;

a mounting member having a mounting surface defining an opening between the mounting surface and the surface of the counterbore for receiving a cutter assembly;

a cutter assembly including a fixed shaft and a cutter mounted for rotation on the fixed shaft;

means on one end of the shaft for slidably fitting in said bore;

shim removably fittable between the mounting surface and the other end of the shaft for permitting axial movement of the shaft when removed and preventing axial movement of the shaft when fitted between the end of the shaft and the mounting surface; and interengaging means on the other end of the shaft and on the mounting member for securing the shaft and the shim means to the mounting member in fixed position with the cutter assembly in the opening.

* * * * *